US006206201B1

(12) United States Patent
Schwartz

(10) Patent No.: US 6,206,201 B1
(45) Date of Patent: Mar. 27, 2001

(54) SORTING APPARATUS FOR UTENSILS

(75) Inventor: Jay Schwartz, 14254 Esther Dr., San Jose, CA (US) 95124

(73) Assignee: Jay Schwartz, San Jose, CA (US)

( * ) Notice: Subject to any disclaimer, the term of this patent is extended or adjusted under 35 U.S.C. 154(b) by 0 days.

(21) Appl. No.: 09/483,533

(22) Filed: Jan. 14, 2000

Related U.S. Application Data

(60) Provisional application No. 60/116,381, filed on Jan. 14, 1999.

(51) Int. Cl.[7] ..... B07B 13/07

(52) U.S. Cl. ..... 209/664; 209/509; 209/659; 209/660

(58) Field of Search ..... 209/509, 659, 209/664, 660, 666, 667, 680, 683, 684, 687

(56) References Cited

U.S. PATENT DOCUMENTS 3,389,790 * 6/1968 Braunheim et al. ..... 209/97
3,612,268 * 10/1971 Jackson ..... 209/73

* cited by examiner

*Primary Examiner*—Donald P. Walsh
*Assistant Examiner*—Mark J. Beauchaine
(74) *Attorney, Agent, or Firm*—Blakely, Sokoloff, Taylor & Zafman LLP

(57) ABSTRACT

A utensil sorting apparatus having a plurality of different buckets, each bucket being adapted to receive one type of utensil and to discharge it from a discharge port. Other utensils received by, for example, the cavity adapted to receive spoons are discharged from the inlet port of the bucket as the bucket rotates. The discharge ports of the spoon buckets are aligned with a first slide, fork buckets with a second slide and knife buckets with a third slide so that utensils slide into bins as they are sorted.

7 Claims, 3 Drawing Sheets

SIDE VIEW

SORTING APPARATUS FOR UTENSILS

Priority is Claimed to Provisional Application Ser. No. 60/116,381, Filed Jan. 14, 1999.

BACKGROUND OF THE INVENTION

1. Field of the Invention

An apparatus is described for the sorting of utensils such as knives, forks and spoons.

2. Prior Art.

The sorting of utensils such as knives, forks and spoons can be an arduous task especially in large restaurants and institutions. Typically the utensils are washed together and then manually sorted into bins.

The present invention provides an apparatus for sorting such utensils.

SUMMARY OF THE INVENTION

A utensil sorting apparatus having a first plurality and second plurality of buckets mounted generally radially on a drum. Each bucket includes an inlet port where all the inlet ports define a generally cylindrically-shaped region centrally disposed on the drum. The first buckets have a first elongated neck and a first cavity adapted to receive a first utensil and discharge a first utensil from a first discharge port as the drum rotates. The second buckets have a second elongated neck and a second cavity adapted to receive a second utensil and to discharge the second utensil from a second discharge port as the drum rotates.

DETAILED DESCRIPTION OF THE INVENTION

An apparatus is described for the sorting of kitchen utensils and the like is disclosed.

Figure 1:
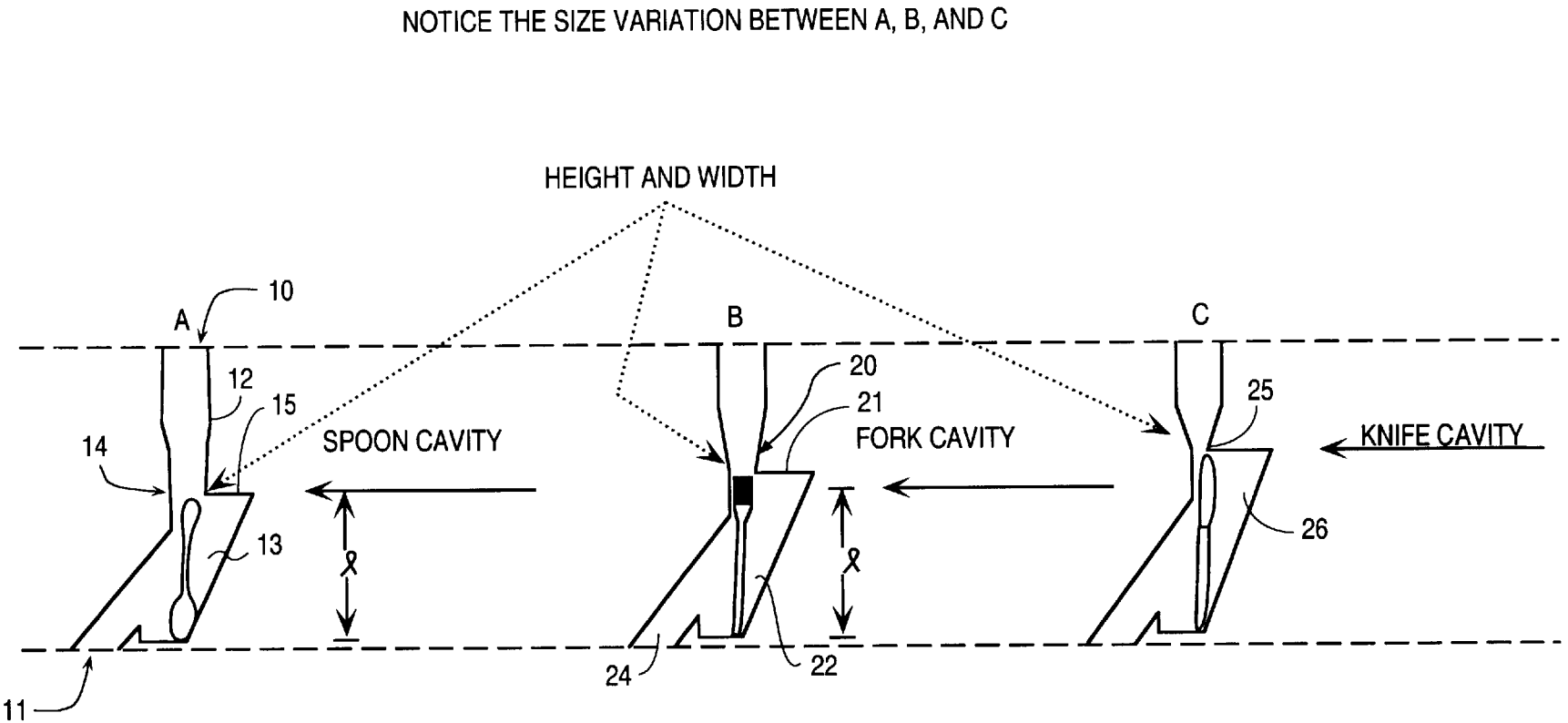
FIG. 1 illustrates three cross-sectional elevation views of buckets where each bucket defines a cavity for a utensil.

The apparatus utilizes a plurality of buckets. There is a plurality of identical buckets for each utensil to be sorted. Three buckets for sorting different utensils are shown in FIG. 1. As will be understood from the following description, if additional utensils are to be sorted such as soup spoons, another plurality of buckets would be used. FIG. 1A shows a first bucket defining a spoon receiving cavity 13. The bucket includes an inlet 10 and a discharge port 1 1. There is an elongated neck section 12 which communicates with the cavity 13 through an orifice 14. The diameter of this orifice and the height of the cavity 13 shown by the dimension 1, are the primary dimensions determining which utensil the bucket will be collected and eventually discharge through the discharge port 11.

In general, the bucket in total is approximately 14 inches high in one embodiment and approximately 2 inches wide in the cavity region. The inlet opening 10 is approximately 2"×2". In one embodiment the bucket is fabricated from fiberglass, this is not critical, however, it is desirable that the interior of the bucket be relatively smooth and slick so that the utensils slide easily within the bucket.

For the spoon bucket in FIG. 1 A the diameter 14 is large enough to pass spoons and as such, is large enough for both the fork and the knife to fall into the cavity 13. In the case of the knife, when one does enter the cavity it will be too long to fall under the lip 15 of the cavity and as the cavity is rotated (as will be discussed) the knife will fall out through the opening 10. As for forks which enter the bucket of FIG. 1 A, they also are too long to fit under the lip 15 and will fall out as will be described.

The bucket of FIG. 1B, while having the same, general, overall dimensions is different from the bucket of FIG. 1A in that the diameter 20 is smaller and the height l is longer than the corresponding "l" of the bucket of FIG. 1A. The bucket of FIG. 1B selects forks only. The diameter 20 is too small for spoons to fall through and consequently, the spoons fall back out of the inlet as the bucket is rotated. As for knives, they also are too long to fit under the lip 21 of cavity 22. As will be seen, the forks fit under the lip 21 and eventually are discharged through the discharge port 24.

The bucket of FIG. 1C receives only knives. The diameter 25 is too small to allow either spoons or forks to fall into the cavity 26 and only the knives are trapped within the cavity 26.

Figure 2:
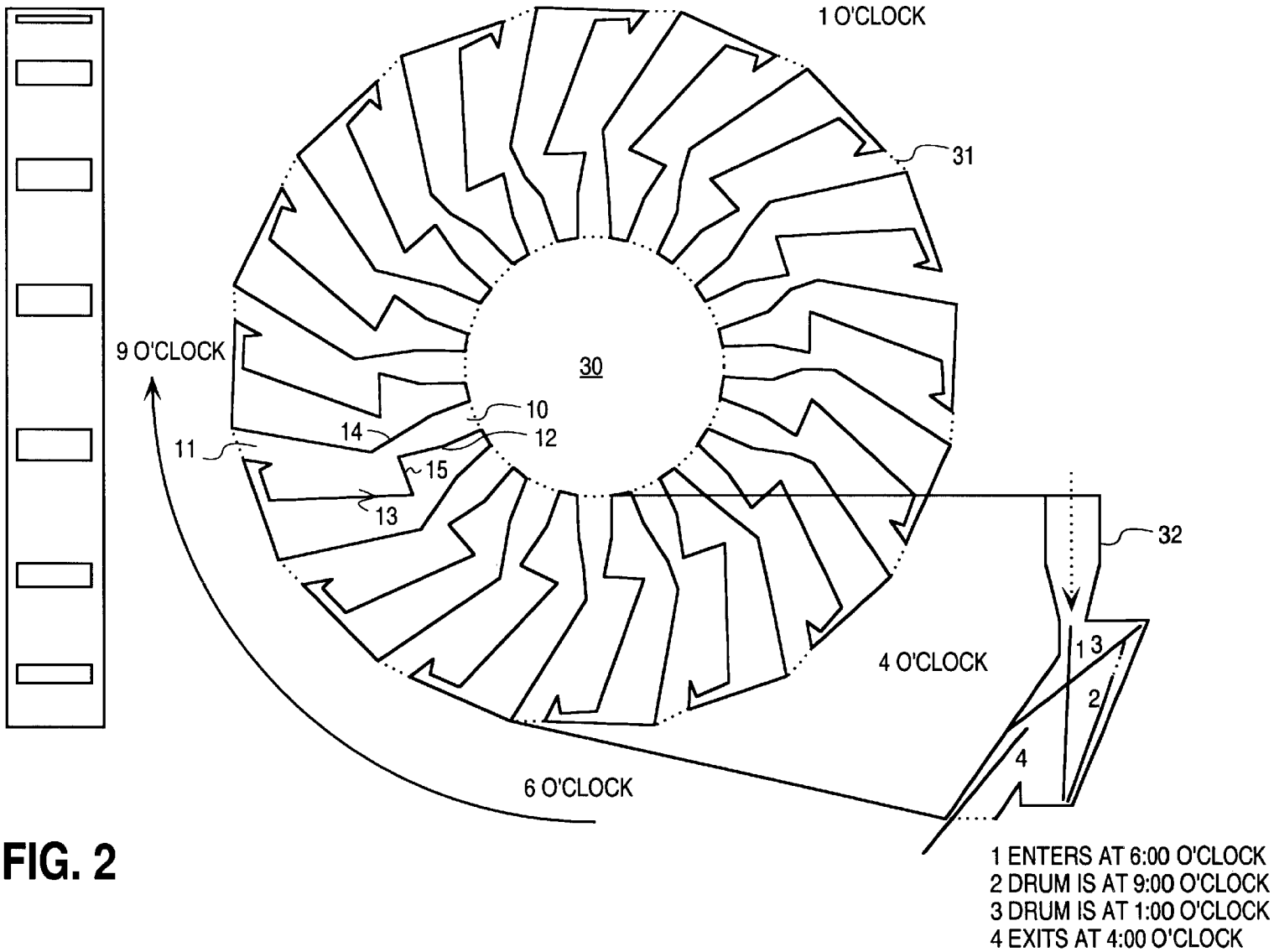
FIG. 2 is an elevation view showing the buckets mounted on a drum.

Buckets of a kind are mounted on a common drum with their inlets facing inward into a central cylindrically shaped region 30 (see FIG. 2). The unsorted utensils as will be seen are dropped into the region 30 and as the drum 31 rotates the utensils are sorted. The only openings into or from the region 30 are the inlets to the buckets and the inlet 54 of FIG. 4 which allows the unsorted utensils to enter the region 30. Assume first for sake of discussion, that all of the buckets of FIG. 2 are the spoon collecting buckets such as shown in FIG. 1A. One such bucket has been numbered in FIG. 2. When in the six o'clock position, spoons will enter the cavity defined by the bucket. This is shown with the number 1 in the cross section of bucket 32. When the bucket is in the nine o'clock position in the drum, the spoon become locked under the lip of the cavity as shown by position 2. As the drum continues to rotate into the one o'clock position, the spoon drops to the position by number 3. Finally, as the drum rotates to the four o'clock position the spoons are discharged as shown by number 4. Any knives or forks which have entered the inlet 10 of the spoon buckets of FIG. 2 will not become locked into the position 2 but rather will fall back into the region 30 at the 10 o'clock to 12 o'clock positions.

Figure 4:
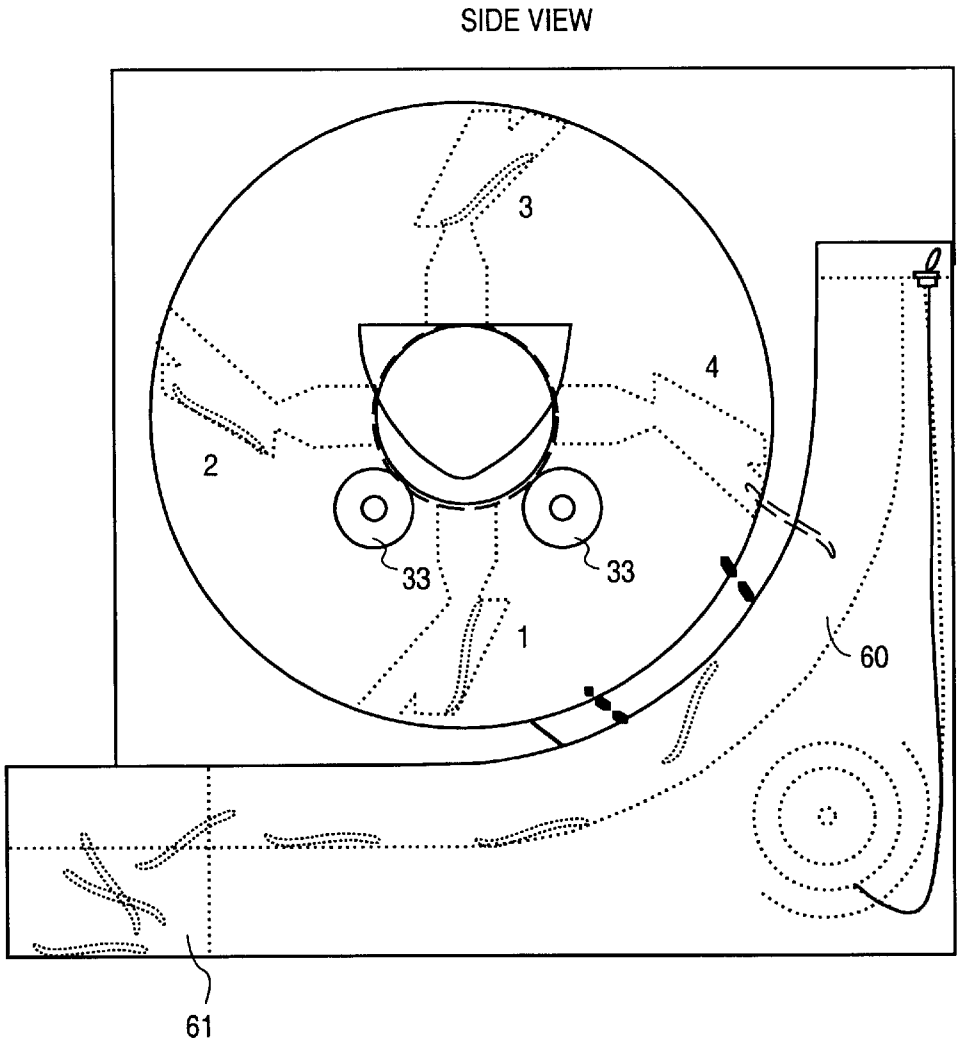
FIG. 4 is a cross-sectional view showing one layer of drums and its communication with a slide and bin
Figure 3:
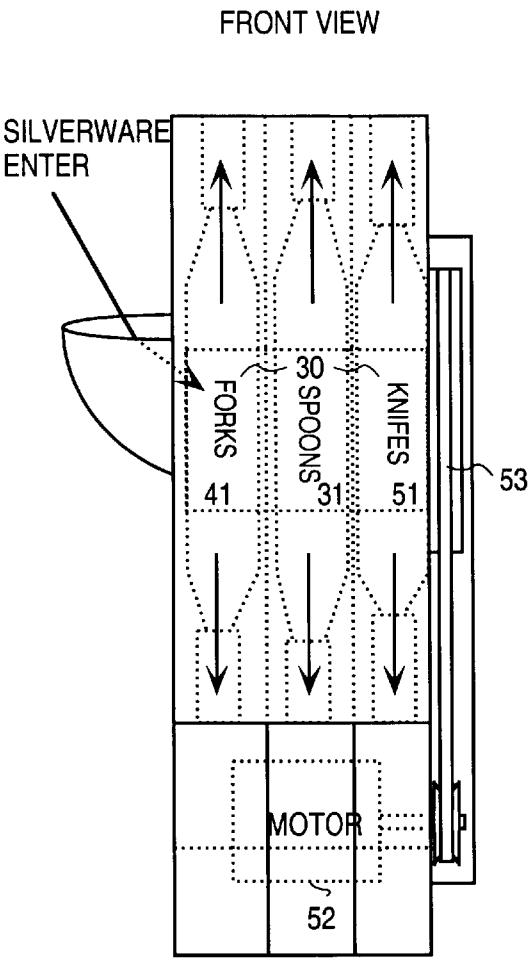
FIG. 3 is a front view showing three layers of buckets, one for each utensil.

Referring now to FIG. 3 the apparatus includes three drums; 41, 31 and 51. Drum 41 includes a plurality of the buckets shown in FIG. 1B, drum 31 a plurality of the buckets shown in FIG. 1A and drum 51 a plurality of the buckets such as shown in FIG. 1C. The buckets rotate together driven by motor 52 and the belt 53. The region 30 receives silverware from the tray 54. As the rotations occur, the utensils tumble from bucket-to-bucket until they are locked in a bucket made to receive that utensil. As that bucket rotates to position 4 of FIG. 4, the utensil drops into a slide 60 and finally into a receiving bin 61. There are three separate slides, one associated with each of the drums of FIG. 3 and three separate bins; one for receiving one type (i.e., fork, spoon or knife) of the utensil. The bearings 33 for supporting the drums are shown in FIG. 4 along with the positions 1, 2, 3 and 4 corresponding to the positions discussed previously in connection with FIG. 2.

Tumblers or baffles may extend into the cavity 30 to, in effect, stir the utensils causing them to drop into the buckets. In one embodiment, the drums rotate at approximately 30 rpm. In one embodiment the cavity 30 has a diameter of approximately 18 inches.

In another embodiment a discharge port is located at the lips 15 or 21 of FIG. 1. For this embodiment the drums' axes are mounted at an angle to the vertical and the drums revolve around the vertical axis.

What is claimed is:

1. A utensil sorting apparatus comprising:

a drum having a plurality of first buckets and a plurality of second buckets mounted generally radially on the drum so as to define a cylindrically-shaped region centrally disposed on the drum each of said first and second buckets having an inlet port communicating with the region;

the first buckets having a first elongated neck and a first cavity adapted to receive a first utensil and discharge the first utensil from a first discharge port as the drum rotates;

the second buckets having a second elongated neck and a second cavity adapted to receive a second utensil and discharge the second utensil from a second discharge port as the drum rotates.

2. The apparatus defined by claim 1 wherein the first buckets form a first layer on the drum and the second buckets a second layer.

3. The apparatus defined by claim 1 wherein the first discharge port opens into a first slide as the drum rotates.

4. The apparatus defined by claim 3 wherein the first and second slides communicate with the first and second bins, respectively.

5. The apparatus defined by claim 4 including a plurality of third buckets forming a third layer of buckets on the drum adapted to receive a third utensil.

6. The apparatus defined by claim 5 where in the first, second and third utensils are knives, spoons and forks.

7. The apparatus defined by claim 4 wherein the first and second buckets discharge the second and first utensils, respectively, from their respective inlet ports into the region.

* * * * *